US010106990B2

(12) United States Patent
Drewery et al.

(10) Patent No.: US 10,106,990 B2
(45) Date of Patent: Oct. 23, 2018

(54) HAZARD WARNING SYSTEM

(71) Applicant: International Business Machines Corporation, Armonk, NY (US)

(72) Inventors: Sarah M. Drewery, Hursley (GB); Colin I. Holyoake, Braishfield (GB); David J. Tolley, Southampton (GB); Julian D. Williams, Hursley (GB)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 15/408,626

(22) Filed: Jan. 18, 2017

(65) Prior Publication Data

US 2018/0202171 A1 Jul. 19, 2018

(51) Int. Cl.

| | |
|---|---|
| ***B66B 9/00*** | (2006.01) |
| ***E04H 6/06*** | (2006.01) |
| ***E04F 15/024*** | (2006.01) |

(52) U.S. Cl.

CPC .. *E04F 15/02458* (2013.01); *E04F 15/02405* (2013.01)

(58) Field of Classification Search

CPC ..... E04F 15/0258; E04F 15/02405; E04F 15/024; E04F 15/02458

USPC ..... 52/29

See application file for complete search history.

(56) References Cited

U.S. PATENT DOCUMENTS

| | | | | |
|---|---|---|---|---|
| 3,918,225 | A * | 11/1975 | Fisher | E04H 3/126 52/115 |
| 4,864,078 | A * | 9/1989 | Bowman | H02G 3/185 174/486 |
| 6,718,714 | B1 | 4/2004 | Montgomery, Sr. | |
| 6,748,707 | B1 * | 6/2004 | Buchalter | E04F 15/024 439/131 |
| 9,745,067 | B2 * | 8/2017 | Guering | B64D 13/00 |
| 2006/0202084 | A1 * | 9/2006 | Smallhorn | B64C 1/18 244/118.5 |
| 2013/0032773 | A1 | 2/2013 | Jette | |
| 2016/0237698 | A1 * | 8/2016 | Ohshima | E04F 15/02423 |

FOREIGN PATENT DOCUMENTS

WO WO 2014/199147 A1 12/2014

OTHER PUBLICATIONS

Anonymous, "Method for self-marking floors, wall, ceilings, and similar facility components", IP.com Prior Art Database Technical Disclosure, IPCOM000005649D, Oct. 23, 2001.

(Continued)

*Primary Examiner* — Brian D Mattei

(74) *Attorney, Agent, or Firm* — Scully, Scott, Murphy & Presser, P.C.; Nicholas Bowman, Esq.

(57) ABSTRACT

A flooring element is provided for a raised floor including removable flooring panels and a supporting structure with a load bearing surface. The flooring element includes a warning element operable for moving between an inactive position in which the warning element is substantially concealed by the surface and an active position in which the warning element projects beyond the surface to form a visual hazard warning indicator. The flooring element may be for example a flooring panel, a stringer, a pedestal, an insert for a pedestal or an insert for inserting between a sub-floor void and a flooring panel.

16 Claims, 13 Drawing Sheets

(56) References Cited

OTHER PUBLICATIONS

Anonymous, "Data Center Smart Tile", IP.com Prior Art Database Technical Disclosure, IPCOM000241008D, Mar. 18, 2015.
"Safety Equipment, PPE and Work Wear Specialists", Safety Equipment and PPE from Aspli Safety Ltd. UK., http://www.aspli.com, last download Aug. 24, 2016, pp. 1-12.
"Retractabke Tensa and Stretch Belt Barriers", http://www.barriersdirect.co.uk, last download Aug. 24, 2016, pp. 1-5.
"Pop-Up Cones", http://www.theworkplacedepot.co.uk, last download Aug. 24, 2016, pp. 1-3.
"Rubbermaid Bins, Recycling Bins, Safety & Cleaning Products", http://www.rubbermaindproducts.co.uk; last download Aug. 24, 2016, pp. 1-3.
"Green Mix of Colors Wavers6mgr", http://www.wavyads.com; last download Aug. 24, 2016, pp. 1-4.

* cited by examiner

HAZARD WARNING SYSTEM

BACKGROUND

The present disclosure generally relates to a hazard warning system for a raised floor having removable flooring panels.

A raised floor is an elevated structural floor spaced above a solid substrate to create a hidden sub-floor void. Many modern building environments incorporate a raised floor. The void provides for the passage of various building services such as electrical and optical cabling, plumbing, and underfloor air distribution. One example of such a building environment is a data center. A data center is typically a room in which rows of data processing and/or telecommunications equipment are installed, each separated from each other by intervening access aisles. The void beneath the raised floor provides space for the routing of services to and between the installed equipment, such as electrical power distribution cabling, communications cabling, plumbing for fluid cooling systems, and a plenum chamber for distribution of conditioned air. The raised floor usually comprises a plurality of removable panels or tiles supported above the underlying substrate by a framework. The framework typically comprises a plurality of equally spaced vertical pedestals defining the height at which the raised floor is raised above the substrate, and thereby defining, along with the floor area, the enclosed volume of the void. The framework also typically comprises a plurality of horizontal stringers arranged in a grid structure of laterally disposed stringers superimposed upon longitudinally disposed stringers, with intersecting stringers meeting each other at right angles. The grid structure thereby divides the raised floor area into a two dimensional array of spaces each sized to accommodate a floor panel or tile. The grid structure is supported above the substrate by the pedestals. Each pedestal is typically situated with one end abutting the substrate and the other end supporting an intersection between a longitudinally disposed stringer and laterally disposed stringer. Depending on the load that the raised floor is expected to carry, not all intersections in the gird structure may be supported by a pedestal. It will be appreciated however that, if the raised floor is expected to be heavily loaded, every intersection may be supported by a pedestal. In another conventional raised flooring system, there are no stringers and instead each corner of a floor panel is supported by a separate pedestal so that, except at the edges of the raised floor, each pedestal supports the meeting corners of four adjacent panels. The substrate is typically a concrete floor. The stringers and pedestals are typically formed from a metal such as steel. The panels are typically formed from steel or steel-clad particleboard.

As indicated earlier, the panels are typically removable to facilitate access to the services in the void, for example for installation or maintenance. When a panel is removed, a potential hazard is created because personnel may not see the gap in the raised floor thereby created and inadvertently fall into the void, leading to possible injury. Conventionally, this problem has been addressed by the provision of portable warning signs or barriers. This conventional approach has disadvantages. Such barriers or signs may be removed, deliberately or inadvertently. Additionally, such barriers or signs must be stored when not in use and replaced after use, and the storage location needs to be convenient. It would be desirable to provide a hazard warning system which addresses these problems.

SUMMARY

Embodiments of the present invention provide a flooring element for a raised floor comprising removable flooring panels and a supporting structure and having a load bearing surface. The flooring element comprises a warning element operable for moving between an inactive position in which the warning element is substantially concealed by the surface and an active position in which the warning element projects beyond the surface to form a visual hazard warning indicator.

In an embodiment, the warning element is deployable from the inactive to the active position responsive to the removal of an adjacent flooring panel.

In an embodiment, the flooring element comprises one of: a flooring panel; a stringer; a pedestal; an insert for a pedestal; and an insert for inserting between sub-floor void and a flooring panel.

In an embodiment, the warning element is substantially perpendicular to the surface when in the active position.

In an embodiment, the warning element is substantially perpendicular to the surface when in the inactive position.

In an embodiment, the warning element is substantially parallel to the surface when in the inactive position.

In an embodiment, the warning element is attached to the flooring element by a pivot, the pivot being adjacent a corner of a flooring panel when in use in a floor, the warning element describing an arc of movement about the pivot in moving between the inactive position and the active position.

In an embodiment, the warning element comprises a telescopic structure extendible from a retracted state in the inactive position to an extended state in the active position.

In an embodiment, the flooring element further comprises a resilient bias for moving the warning element from the inactive position to the active position.

In an embodiment, the warning element is lockable in the active position.

In an embodiment, the warning element comprises one or more of: a plate; a perforated plate; a mesh; an elongate member; and a plurality of elongate members.

In an embodiment, the warning element comprises one or more flexible elements operable for moving from the inactive position to the active position upon removal of an adjacent floor panel in response to a resulting flow of air through a flooring gap resulting from removal of the adjacent floor panel.

In an embodiment, the flexible element comprises one or more of a streamer and a tube.

In an embodiment, the warning element comprises a plurality of warning elements.

In an embodiment, the plurality of warning elements are linked by a flexible web.

Viewed from another aspect, the disclosure is directed to a flooring system comprising a flooring element of any of the previous embodiments.

BRIEF DESCRIPTION OF THE DRAWINGS

Embodiments of the present invention will now be described, by way of example only, with reference to the following drawings in which.

DETAILED DESCRIPTION

Embodiments of the invention provide a hazard warning system for a raised floor system. The hazard warning system comprises a hazard warning mechanism which is operable for deploying into a warning position when a corresponding panel of the raised floor is removed.

Figure 1:
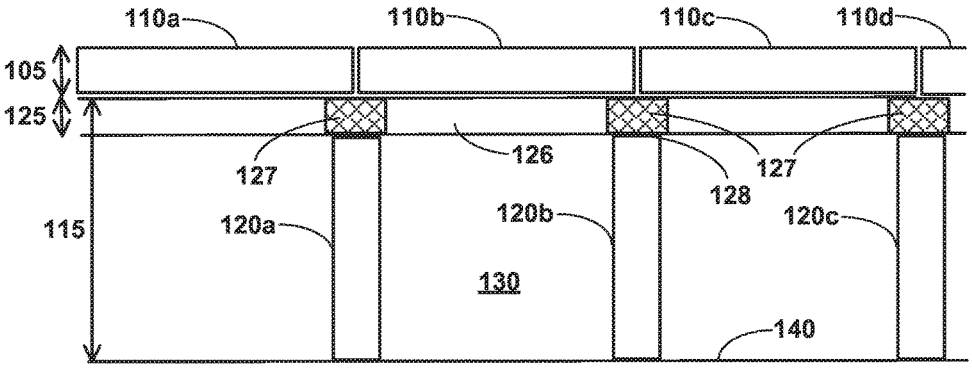
FIG. 1 is a cross sectional view of a raised floor system comprising flooring panels.

Referring to FIG. 1, in one embodiment, a raised floor system comprises a raised floor 105 which is elevated above a solid substrate 140 to create a hidden sub-floor void 130. The void 130 provides for the passage of various building services such as electrical and optical cabling, plumbing, and underfloor air distribution (not shown). The raised floor 105 comprises a plurality of removable panels or tiles 110*a*-110*d* supported above the underlying substrate 140 by a framework 115. The framework 115 comprises a plurality of equally spaced pedestals 120*a*-120*c* defining the height at which the raised floor 105 is raised above the substrate 140, and thereby defining, along with the floor area, the enclosed volume of the void 130. The framework 115 also comprises a plurality of stringers 125 arranged in a grid structure of laterally disposed stringers 126 superimposed upon longitudinally disposed stringers 127 with intersecting stringers meeting each other at right angles. The grid structure of stringers 125 thereby divides the raised floor area into a two dimensional array of spaces each sized to accommodate a floor panel 110*a*-110*d*. The grid structure of stringers 125 is supported above the substrate 140 by the pedestals 120*a*-120*c*. Each pedestal 120*a*-120*c* is situated with one end abutting the substrate 140 and the other end supporting an intersection 128 between a longitudinally disposed stringer 127 and laterally disposed stringer 126. In some embodiments, not all intersections 128 in the grid structure may be supported by a pedestal 120*a*-120*c*. In other embodiments, each intersection 128 in the grid structure is supported by a pedestal 120*a*-120*c*. The selection depends on the load that the raised floor is expected to carry. The substrate 140 may be a concrete floor. The stringers 125 and pedestals 120*a*-120*c* may be formed from a metal such as steel. The panels 110*a*-110*d* may be formed from steel or steel-clad particleboard. It will be appreciated, however, that this embodiment is not limited to raised floor systems involving such materials, or the combination thereof, and that, in other embodiments, different materials, and/or combinations thereof, may be employed.

The panels 110*a*-110*d* are removable to facilitate access to the services in the void 130, for example for installation or maintenance. When a panel 110*a*-110*d* is removed, a potential hazard is created because personnel may not see the gap in the raised floor 105 thereby created and inadvertently fall into the void 140, leading to possible injury.

Figure 2:
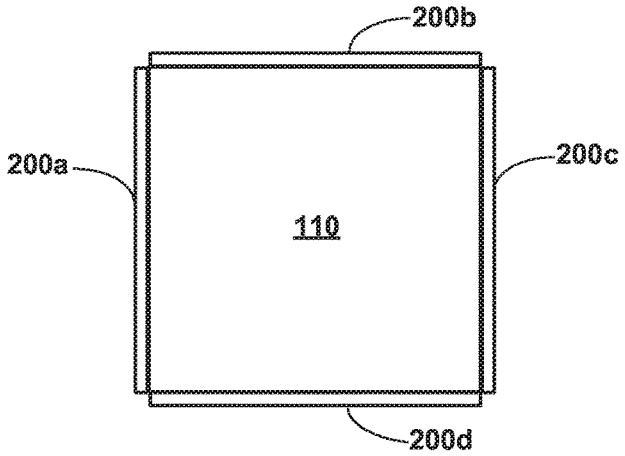
FIG. 2 is a plan view of a raised floor system panel embodying the present invention.

Referring to FIG. 2, in one embodiment, each panel 110 comprises along each side having a substantially vertical orientation when in use in a flooring system a hazard warning indicator or sign 200*a*-200*d* in the form of a flap. The flap is hinged along an upper edge of the side so as to be pivotable between an inactive position in which the sign 200*a*-200*d* is flush with the side and an active position in which the sign 200*a*-200*d* extends laterally from and in substantially the same plane as the side. When the panel is in situ in the floor, each sign 200*a*-200*d* lies in its inactive position concealed against the corresponding vertical edge of the host panel 110.

Figure 3:
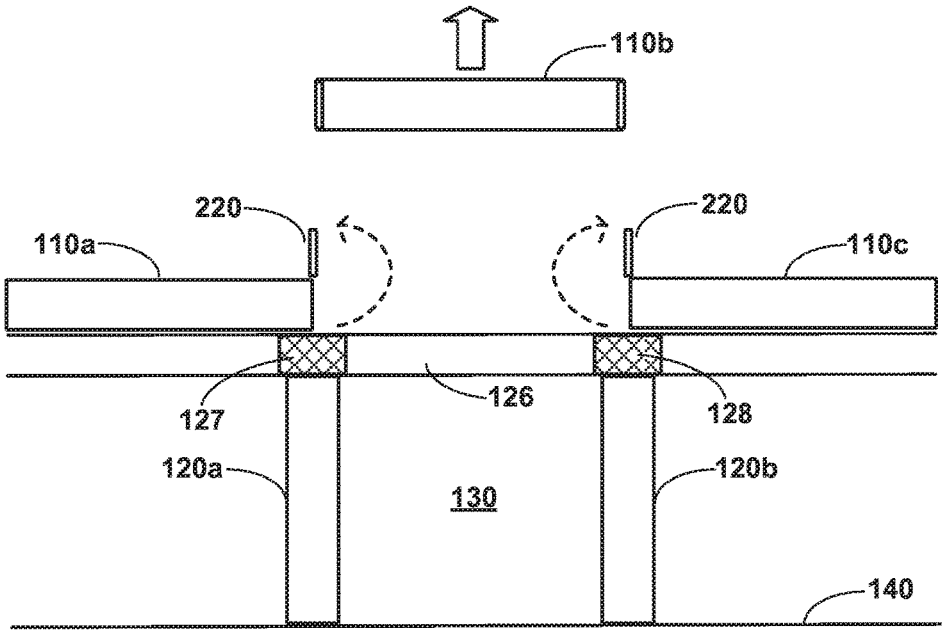
FIG. 3 is a cross sectional view of a raised floor system embodying the present invention.

Referring to FIG. 3, when a panel 110*b* is removed to gain access to the void 130, the signs on the sides of adjacent panels 110*a*, 110*c* which are exposed by removal of the removed panel 110*b* can be deployed upwardly from their inactive position to their active position. Such deployment may be manual or automatic, actuated, in the latter case, by removal of a panel 110. In the latter case, each sign 200 may be resiliently biased, by a spring, for example, to automatically deploy from the inactive position to the active position upon removal of an adjacent panel 110. In such deployment, the motion of each sign 200 follows an arc through one hundred and eighty degrees, as shown in FIG. 3. It will be appreciated that other arrangements for deploying the sign 200 are possible without departing from the scope of the invention. For example, some embodiments may comprise a mechanical retaining latch for retaining each sign 200 in an inactive position until an operator releases it to allow a bias such as a spring to urge the sign 200 to the active position. Each sign 200 may be solid, perforated, or a series of individual elongated members, and may carry hazard markings such as alternate yellow and black diagonal striping. It will be appreciated that each sign may alternatively have other forms and/or surface finishes.

Figure 4:
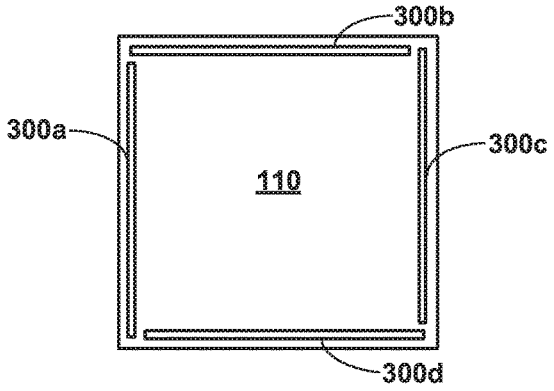
FIG. 4 is a plan view of another raised floor system panel embodying the present invention.
Figure 5:
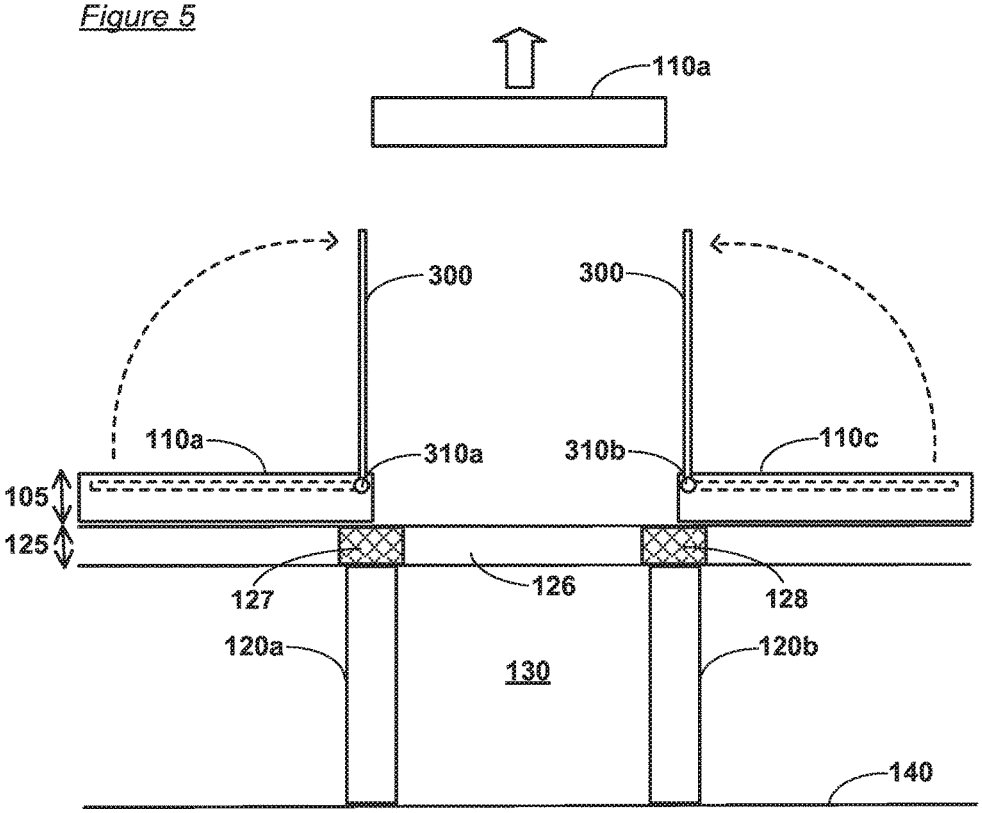
FIG. 5 is a cross sectional view of a raised floor system embodying the present invention.

Referring to FIGS. 4 and 5 in combination, in another embodiment, each panel 110 again comprises four signs 300*a*-300*d*. However, here, the signs 300*a*-300*d* are in the form of legs that are free at one end and pivotably connected to the panel 110 at the other. The pivotal connection may, for example, be implemented by a retaining pin or spindle 310*a*, 310*b* providing for rotational movement of the corresponding sign 300*a*-300*d* relative to the panel 110. Each sign 300*a*-300*d*, in its inactive position, sits within a recess (not shown) formed in the upper surface of the panel 110. Each sign 300*a*-300*d* is thus flush with the surface in its inactive position. When deployed, each sign 300*a*-300*d* is pivoted out of its corresponding recess into its active position to indicate that an adjacent panel 110*b* has been removed. Sign 300*a*-300*d* may comprise any form suitable for remaining substantially flush with the surface of the hosting panel 110 in the inactive position. For example, signs 300*a*-300*d* may be round, square, or rectilinear in cross section, and/or may be formed from solid or hollow material. Again, deployment from the inactive position to the active position may be manual or automatic, actuated, in the latter case, by removal of a panel 110. In the latter case, each sign 300*a*-300*d* may be resiliently biased, by a spring, for example, to automatically deploy from the inactive position to the active position upon removal of an adjacent panel 110. In such deployment, the motion of each sign 300*a*-300*d* follows an arc through ninety degrees, as shown by the dashed arrows in FIG. 5. It will be appreciated that other arrangements for deploying the sign 300 are possible without departing from the scope of the invention. For example, some embodiments may comprise a mechanical retaining latch for retaining each sign 300*a*-300*d* in an inactive position until an operator releases it to allow a bias such as a spring to urge the sign 300*a*-300*d* to the active position. Each sign 300*a*-300*d* may comprise a tab or the like to facilitate manual raising. Additionally, each sign 300*a*-300*d* may comprise a lock for locking the sign 300*a*-300*d* in the active position.

Figure 6:
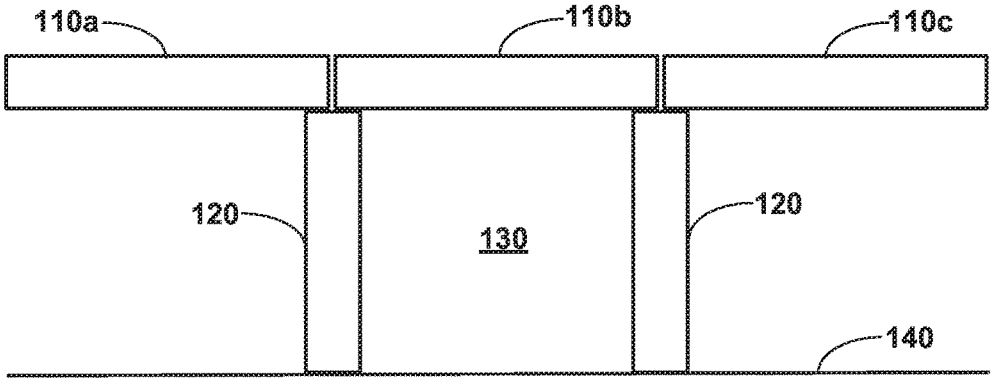
FIG. 6 is a cross sectional view of a stringerless raised floor system.

Referring to FIG. 6, in another embodiment, there are no stringers and instead each corner of a panel, 110*a*-110*c* illustrated, is supported by a separate pedestal 120 so that, except at the edges of the raised floor 105, each pedestal 120 supports the meeting corners of four adjacent panels 110*a*-110*c* illustrated.

Figure 7:
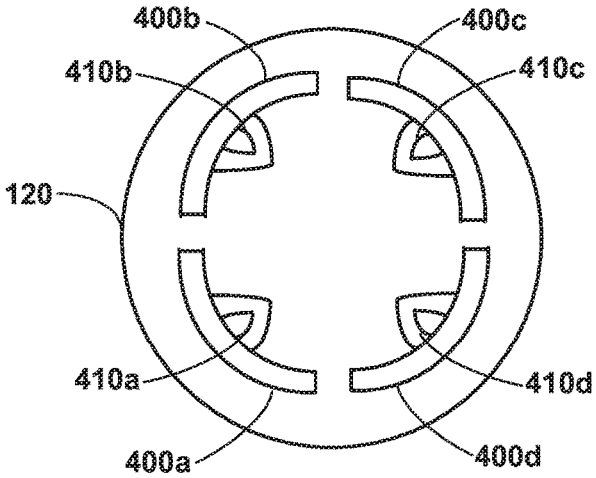
FIG. 7 is a plan view of a stringerless raised floor system pedestal embodying the present invention.
Figure 8:
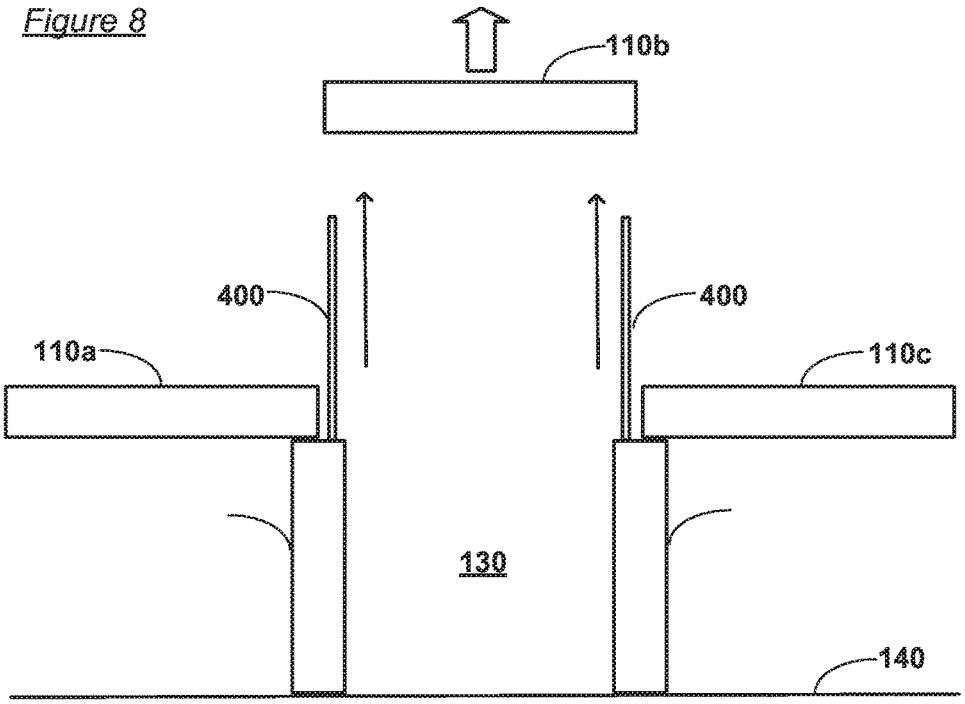
FIG. 8 is a cross sectional view of a stringerless raised floor system embodying the present invention.

Referring to FIGS. 7 and 8, in the FIG. 6 arrangement, each pedestal 120 comprises four signs 400*a*-400*d*. Each sign 400*a*-400*d* corresponds to a different quadrant of the end of the pedestal 120 supporting panels 110. Each quadrant corresponds to a different one of the four meeting corners of the four adjacent panels, 110*a*, 110*c* illustrated, supported by the pedestal 120. When one of these panels 110*a*, 110*c* is removed the corresponding quadrant on the underlying end of the pedestal 120 is exposed, together with the end of the corresponding sign 400*a*-400*d*. The corresponding sign 400*a*-400*d* can then be drawn out from it inactive position housed within the pedestal 120 to its active position raised above the raised floor 105 and extending upwardly from the pedestal 120. A tab 410*a*-410*d* may be provided at the end of each sign 400*a*-400*d*, sitting within a recess in the pedestal end when the sign 400*a*-400*d* is in its inactive position, to facilitate extraction of the sign 400*a*-400*d* into its active position. When each of signs 400*a*-400*d* is in its inactive position, the corresponding tab 410*a*-410*d* is flush with the floor supporting end of the hosting pedestal 120. In the embodiment shown in FIG. 7, the signs 400*a*-400*d* are in the form of curved strips. However, it will be appreciated that, in other embodiments, the signs 400*a*-400*d* may have different cross-sectional shapes, such as round or square, for example. It will also be appreciated that such signs 400*a*-400*d* may be telescopic in operation, deploying into the active position in several coaxial sections. It will further be appreciated that deployment of the signs 400*a*-400*d* from their inactive positions to their active positions may be manual or automatic, via a bias, upon removal of a panel 110. The bias may be implemented by spring, or pneumatic piston, or the like. There may be a manually operable mechanical catch provided to retain each sign 400*a*-400*d* during removal of a panel 110, releasable, for example, by manually depressing slightly the corresponding sign 400*a*-400*d*, after which the corresponding sign 400*a*-400*d* is freed to elevate under the action of the bias.

Figure 9:
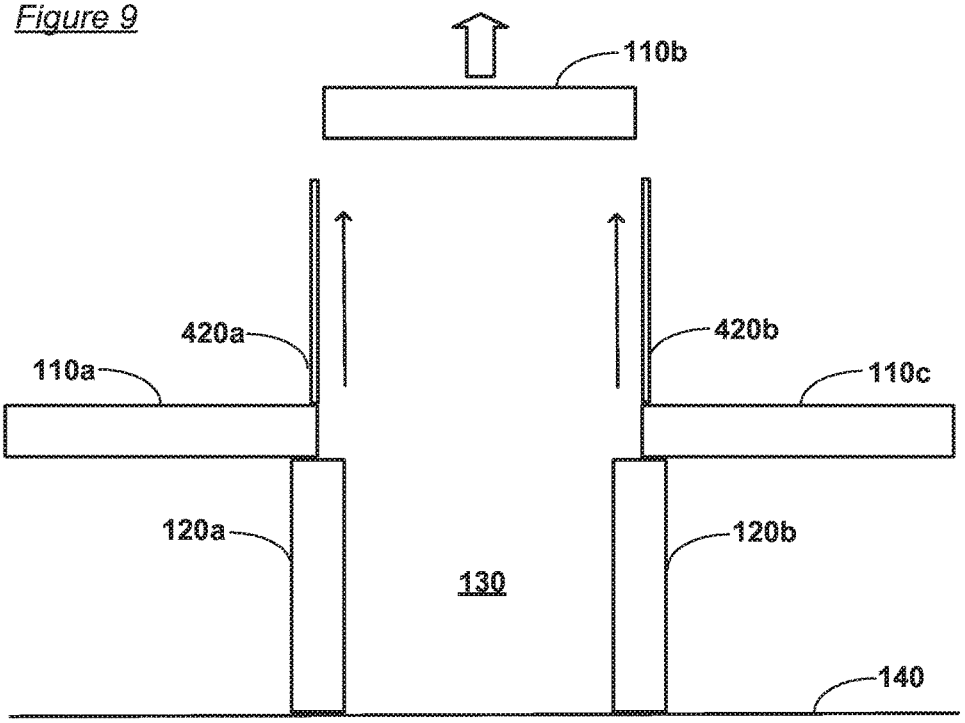
FIG. 9 is a cross sectional view of another stringerless raised floor system embodying the present invention.

Referring to FIG. 9, in another embodiment, each panel 110*a*-110*c* comprises at each of its 4 corners a sign 420*a*, 420*b* in the form of an elongate flexible element deployable from its inactive concealed position to its active position by release of an air flow out of the void 130 through removal of a panel 110. The elongate flexible element may be, for example, a streamer or inflatable sock formed from a suitably lightweight material, such as woven fabric or plastic sheet.

Figure 10:
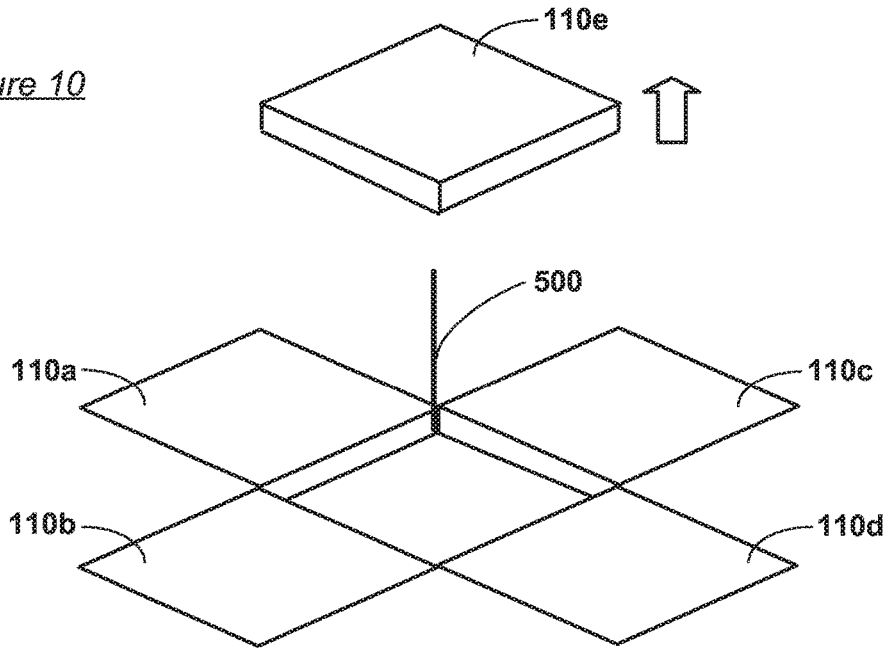
FIGS. 10, 11 and 12 are isometric views of a raised floor system embodying the present invention.
Figure 11:
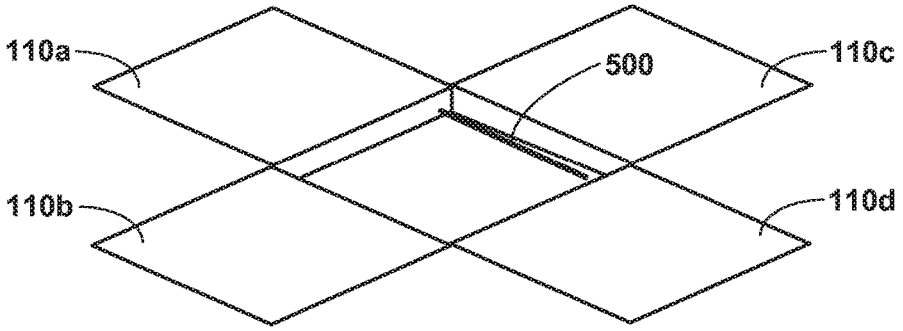
Figure 12:
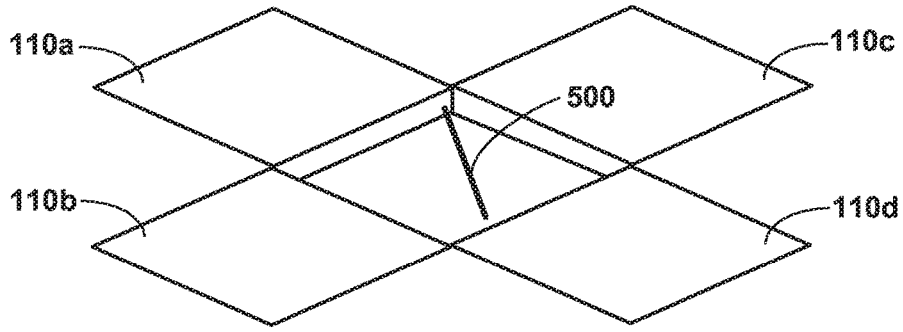

Referring to FIGS. 10 to 12, in another embodiment, each sign 500 is in the form a pole. Each panel 110*a*-110*e* has such a sign 500 pivotably attached in or on the under surface of each side. When a panel 110*e* is removed, one or more of the signs 500 thereby exposed in the surrounding panels 110*a*-110*d* may be deployed, automatically or manually, as hereinbefore described, from the inactive position to the active position. FIG. 10 shows the raised floor system with a panel 110*e* removed and such a sign 500 pivoted into its active position. FIG. 11 shows the raised floor system with such a sign 500 retracted into its inactive position along a side of a panel 110*c* adjacent a gap in the raised floor 105 caused by removal of a panel 110*e*. FIG. 12 shows a variation on the FIG. 11 arrangement, in which, in the inactive position, the sign 500 extends diagonally beneath the space occupied by the removed panel 110*e*.

Figure 13:
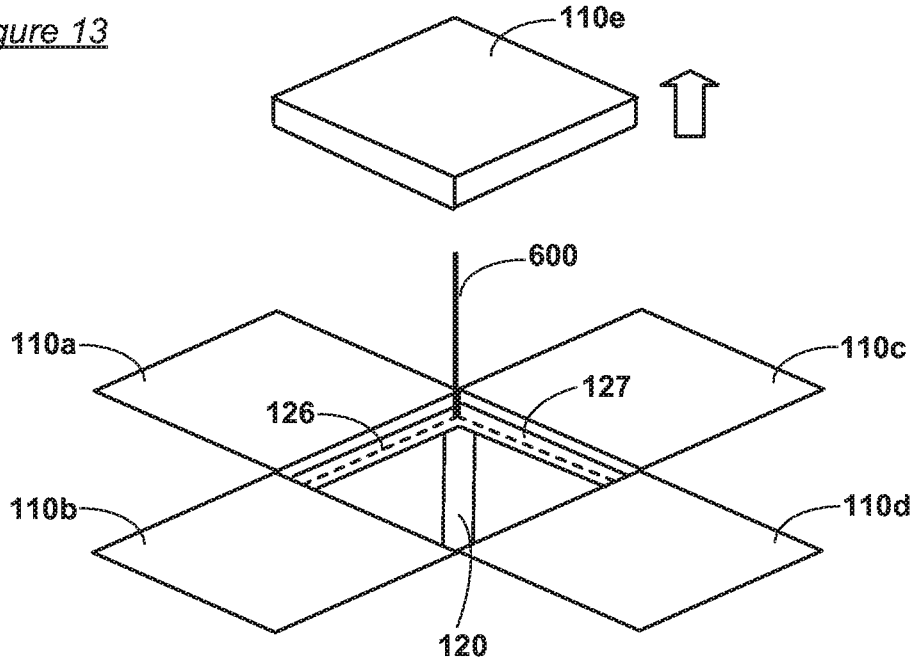
FIGS. 13, 14 and 15 are isometric views of another raised floor system embodying the present invention.
Figure 14:
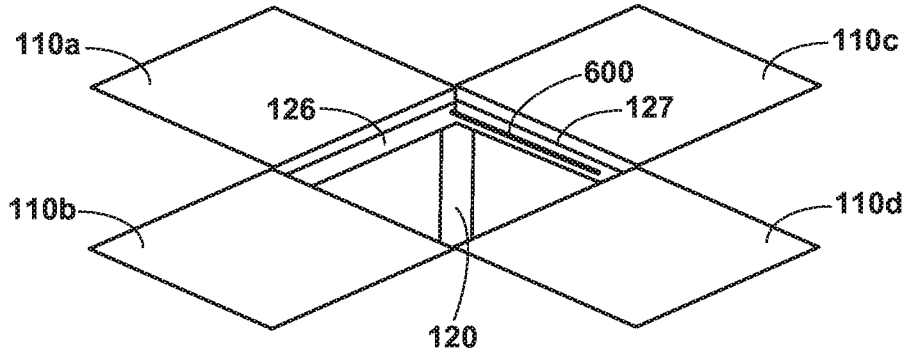
Figure 15:
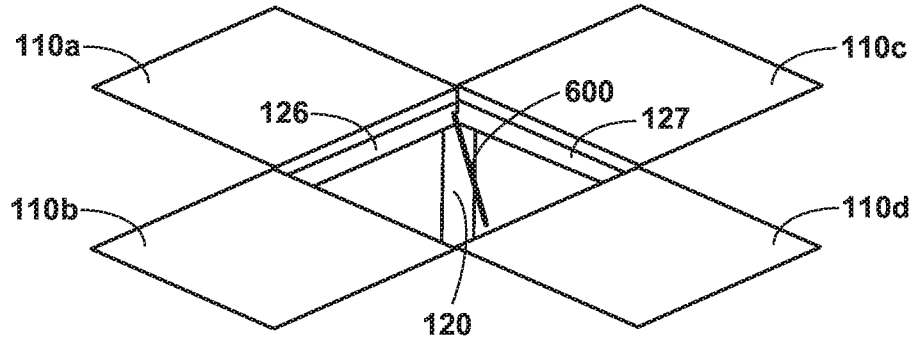

Referring to FIGS. 13 to 15, in another embodiment, each sign 500 is again in the form of a pole, but here each sign 500 is pivotably attached to a stringer 127, 126 so that removal of a panel 110*e* exposes 4 signs 600 each in the inactive position and each of which can then be lifted, manually or automatically as hereinbefore described, into the active position. FIG. 13 shows the raised floor system with a panel 110*e* removed and such a sign 600 pivoted into its active position. FIG. 14 shows the raised floor system with such a sign 600 retracted into its inactive position on the stringer 127 along a side of a panel 110*c* adjacent a gap in the raised floor 105 caused by removal of a panel 110*e*. FIG. 15 shows a variation on the FIG. 13 arrangement, in which, in the inactive position, the sign 600 extends diagonally beneath the space occupied by the removed panel 110*e*.

Figure 16:
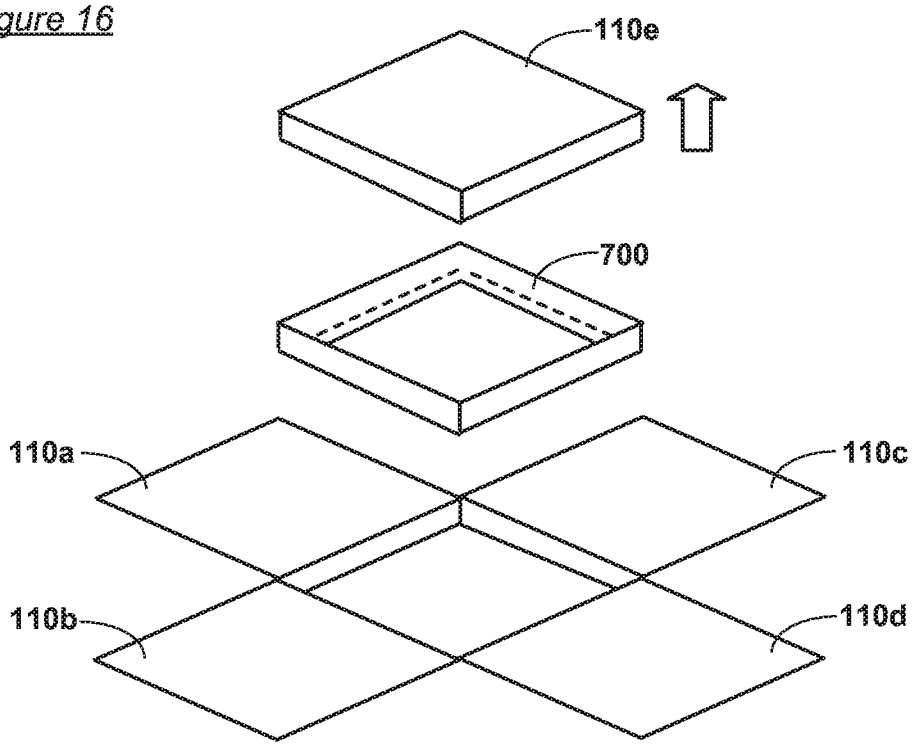
FIG. 16 is an isometric view of a raised floor system with an insert embodying the present invention.
Figure 17:
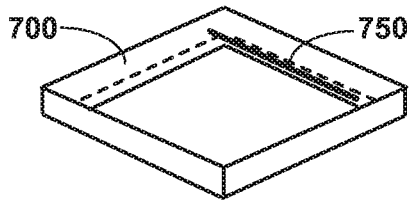
FIG. 17 is an isometric view of an insert embodying the present invention.
Figure 18:
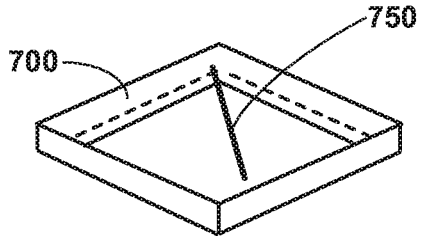
FIG. 18 is an isometric view of another insert embodying the present invention.

With reference to FIG. 16, in an embodiment, the signs are attached, for movement between the inactive and active positions, to an insert 700 in the form of a frame into which panel 110*e* to be removed sits. The insert in turn sits on the stringers of the raised floor system, or, if the raised flooring system is stringerless, at its corners on the pedestals. FIG. 17 shows the insert 700 with such a sign 750 retracted into its inactive position on the stringer 127 along a side of the frame. FIG. 18 shows a variation on the FIG. 17 arrangement, in which, in the inactive position, the sign 600 extends diagonally towards the centre of the frame.

Figure 19:
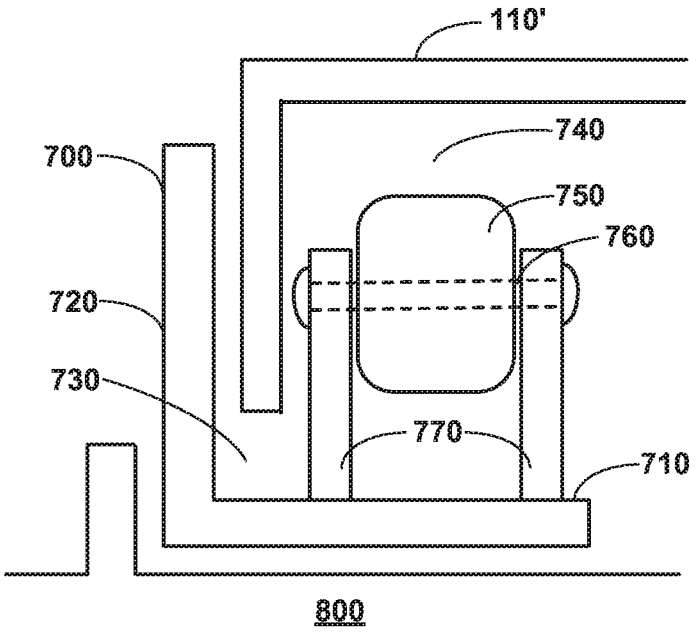
FIG. 19 is a cross sectional view of an insert embodying the present invention.

Referring to FIG. 19, in a preferred embodiment, the insert 700, in the form of a frame, has a right angled cross section. The frame thus has a base portion 710 for abutting a support 800, which may be a pedestal or stringer depending on the type of raised floor system, and a side portion 720 extending perpendicularly from the base portion 710 to define a periphery of the frame. The insert 700 defines substantially the same volume and dimensions as a panel of the raised floor system. A modified panel 110' fits within the side portion 720 of the insert 700, and when in situ within the insert, sits on the base portion 710 of the insert. The modified panel 110' has a recessed interior 740 on its underside to accommodate the signs 750. Thus, the modified panel 110' and insert 700 fit together in a nested relationship to collectively occupy substantially the same volume and dimensions as a panel of the raised floor system. The insert 700 has four pairs of uprights 770 each arranged near a different corner of the inserts and each extending upwardly from the base portion 710. Each pair of uprights 770 supports a pin or spindle 760. In turn, each pin 760 passes through a bore through the sign 750 near to an end thereof to provide for rotational movement of the sign 750 between the inactive position and the active position.

Figure 20:
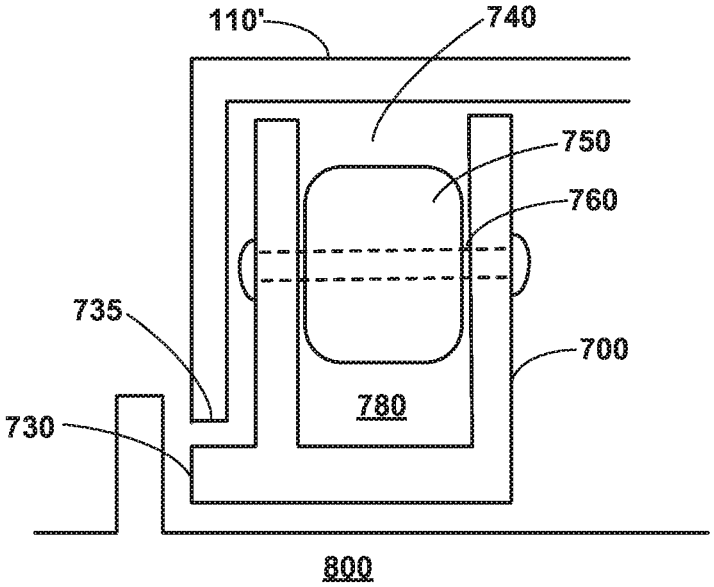
FIG. 20 is a cross sectional view of another insert embodying the present invention.

Referring to FIG. 20, in a modification to the embodiment hereinbefore described with reference to FIG. 19, the modified panel 110' is again recessed on it underside, but no longer of reduced size to fit within the insert 700. Instead the insert 700 is made slightly smaller to fit within the modified panel 100'. The base portion 710 has a peripheral flange for supporting an underside rim 735 of the modified panel 110, when the modified panel 110' and insert 700 are nested together. The insert 700 has parallel side walls extending perpendicularly upwardly from the base portion to define a peripheral, substantially U-shaped channel 780. Each of four pins 760 is again disposed near a different corner of the frame of insert 700, traversing the channel 780 from one side wall to the other. Again, each pin 760 supports an end of a sign 750 for rotational movement between the inactive and active positions.

It will be appreciated that the modified panels 110' and inserts 700 hereinbefore described with reference to FIGS. 19 and 20 may be advantageously retrofitted to existing raised floor systems, where the locations of panels 110 that require frequent lifting for inspection or maintenance purposes are known. The panels 110 at those locations can then simply be replaced by modified panels 110' and inserts 700 hereinbefore described with reference to FIGS. 19 and 20.

Figure 21:
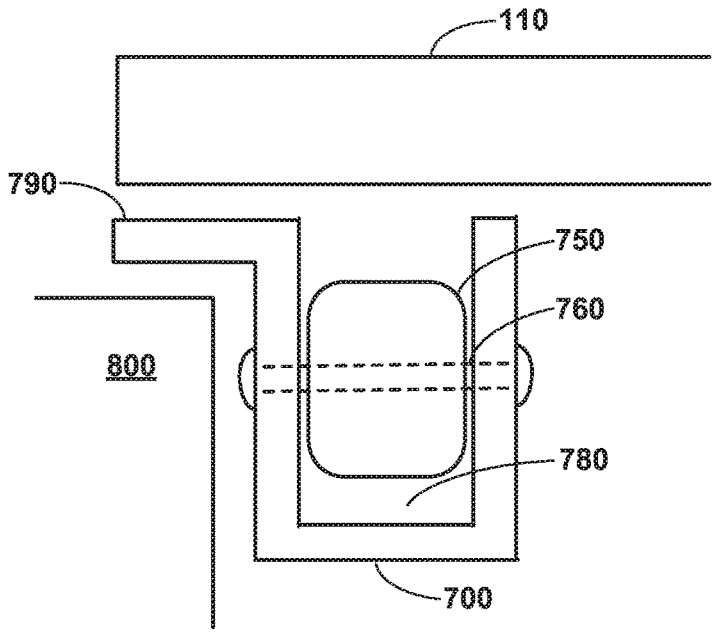
FIG. 21 is a cross sectional view of a further insert embodying the present invention.

Referring to now to FIG. 21, in a particularly preferred embodiment, the insert 700 is advantageously designed to sit on the support 800, whether that be a stringer or a pedestal, immediately below any panel 110 of the raised floor system. No modified panel is required. Accordingly, this embodiment is particularly useful for upgrading existing raised floor systems. Here, the insert 700 again comprises a frame defined by the peripheral, substantially U-shaped channel 780 between outermost and innermost parallel side walls extending perpendicularly upwardly from a base portion. Now, however, a peripheral flange or lip 790 having upper and lower surfaces extends laterally outwardly from the upper extremity of the outermost side wall. In operation, the lower surface of the lip 790 abuts the support 800 to support the insert 700 at a point just below the panel 110 above, when in situ. The lip 790 thus sits between the underlying support 800 and the overlying panel 110, when in situ. The lip 790 may be continuous about the periphery of the insert 700, or broken into a series of tabs spaced about the periphery of the insert 700. Each of four pins 760 is again disposed near a different corner of the insert 700, traversing the channel 780 from one side wall to the other. Again, each pin 760 supports an end of a sign 750 for rotational movement between the inactive and active positions.

Figure 22:
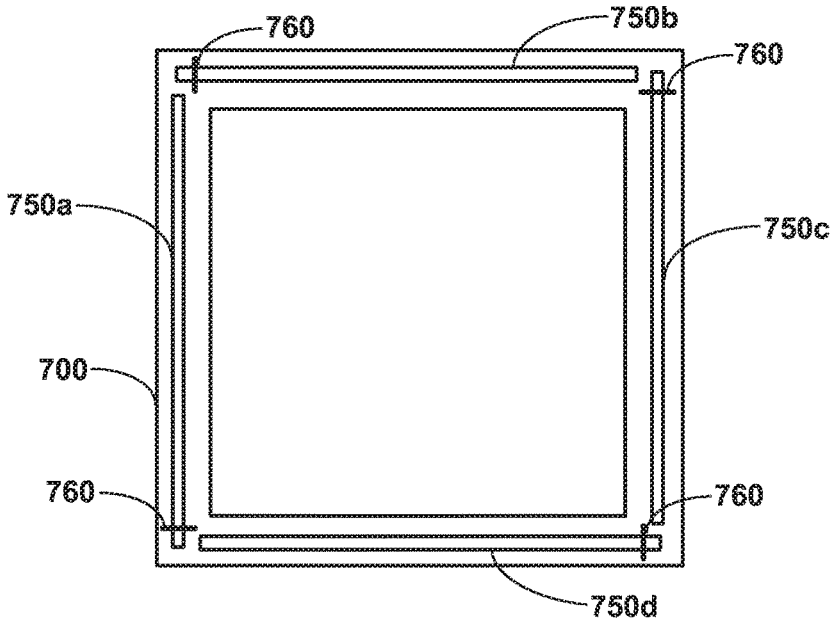
FIG. 22 is a plan view of an insert embodying the present invention.

Referring to FIG. 22, as hereinbefore described, in each of the embodiments hereinbefore described with reference to FIGS. 19 to 20, there are four signs 750*a*-750*d* each pivotably attached to the insert 700 at a point near to a different corner of the frame by pins 760.

Figure 23:
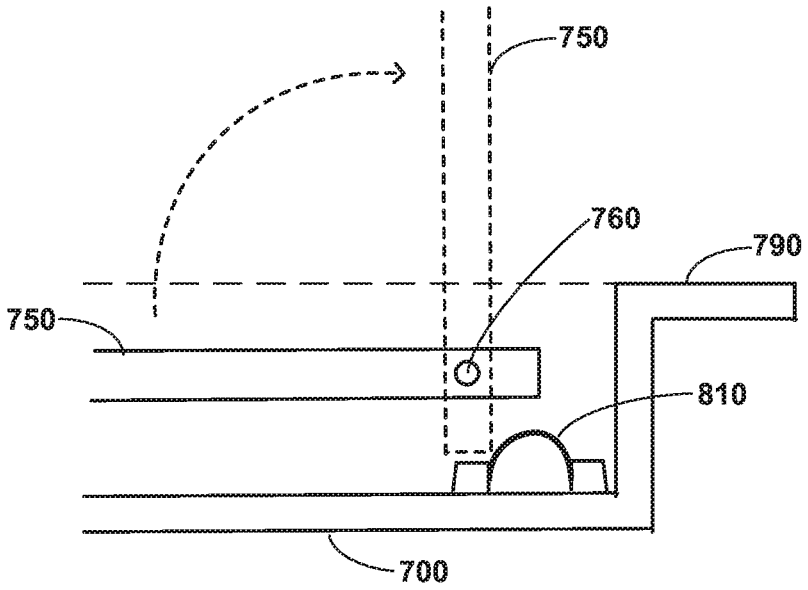
FIG. 23 is a cross sectional view of an insert embodying the present invention.

With reference to FIG. 23, in a preferred example of the embodiment hereinbefore described with reference to FIG. 21, near to each corner of the insert 700, on the base portion thereof, there is provided a spring detent 810 for retaining the corresponding sign 700 in the active position and in the inactive position, but nevertheless allowing for pivotal movement of the sign 700 between the active and inactive positions about axis of rotation provided by the pin 760. The spring detent comprises a strip of resilient material such as spring steel which is held in compression by end stops fixed to base portion of the insert 700 such that it bows upwardly towards the pin 760. As the corresponding sign 750 is raised, the end thereof closest to pin 760 engages with and presses upon the spring detent, which, in turn urges the sign 700 into the upright, active position and thereafter retains the sign 700 in that position Likewise, as the corresponding sign 700 is lowered into the inactive position, the end thereof closest the pin 760 again engages with and presses upon the spring detent 810, which urges the sign 700 into the inactive position, lying parallel to the base portion of the insert 700. It will be appreciated that, in other embodiments, the spring detent may be replaced by a ball detent, or like detent.

Figure 24:
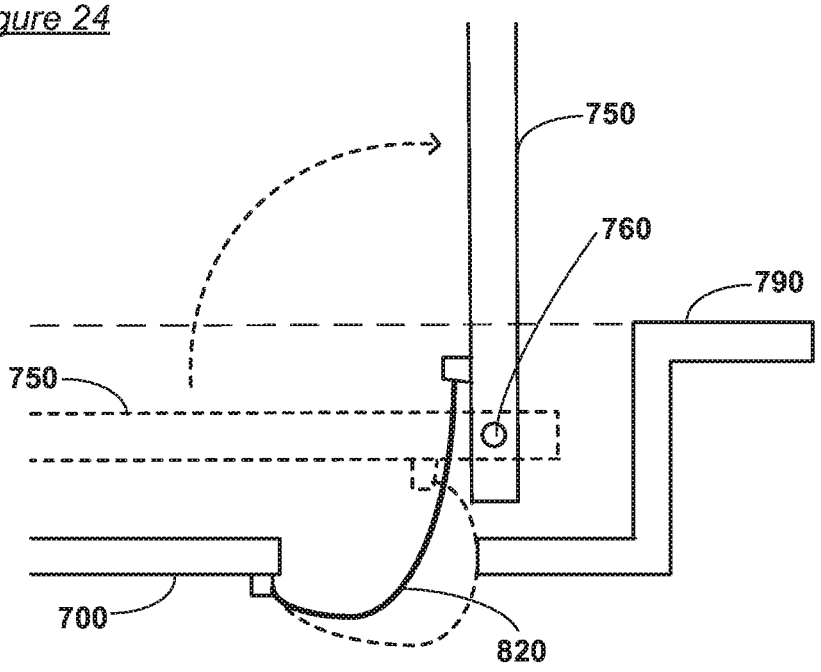
FIG. 24 is a cross sectional view of another insert embodying the present invention.

With reference to FIG. 24, in another preferred example of the embodiment hereinbefore described with reference to FIG. 21, near to each corner of the insert 700, on the base portion thereof, there is provided a spring strip 820 fixed at one end to the underside of the base portion of the insert 700 and at the other end to the corresponding sign 750 at a point offset from the pin 760 though the sign 750 in the direction of the free end of sign 750. The spring strip 820 is formed from spring steel or similar resilient material. In operation, the spring strip 820 is held in compression when the corresponding sign 750 is in the inactive position and, when released, urges the sign 750 into the active position. An aperture is formed in the base portion of the insert 700 to accommodate flexing of the spring strip 820 between the active and inactive positions. In the inactive position, each sign 750 may be held in place, against the force of the corresponding spring strip 820 by the overlying panel 110 so that, when the overlying panel 110 is removed, each sign 750 is free to flip into the active position under the action of the corresponding spring strip 820. It will be appreciated that a catch may be provided in such an arrangement to hold each sign 700 in place after removal of the overlying panel 110 until, for example, the sign 700 is, for example, depressed slightly to disengage the catch and thereby permit motion of the sign 700 into the active position under the action of the spring strip 820.

Figure 25:
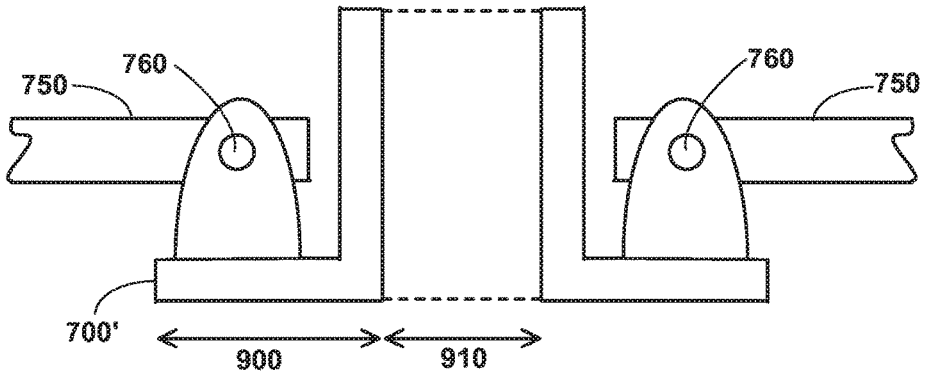
FIG. 25 is a cross sectional view of yet another insert embodying the present invention.

Referring now to FIG. 25, another embodiment provides an insert 700' for a stringer-based or stringerless raised floor system. The insert 700' is in the form of a flanged collar for fastening to a pedestal 120 of a raised floor system at a point below but near to the underside of a panel 110 supported by the pedestal 120. The insert 700' comprises a barrel portion 910 for receiving the pedestal 120 and a flanged portion 920 protruding radially outwardly from the barrel portion 910 at or near end thereof. A surface relief such as a knurl is preferably applied to the interior surface of the barrel portion 910 collar to facilitate the insert 700' gripping the pedestal 120 upon installation. Four pairs of uprights are attached to and disposed equidistantly about the flanged portion 700'. Each pair of uprights supports a pin 760. In turn, each pin 760 passes through a bore through the sign 750 near to an end thereof to provide for rotation rotational movement of the sign 750 between the inactive position and the active position. In operation, the insert 700 is fixed to the pedestal 120 such that each of the four signs 750 carried by the insert 700 points towards the centre of a different one of the four panels 110 having corners that meet on the pedestal 120. Thus, under each panel 110, there are four signs 750 each pointing towards the centre of the panel 110. Accordingly, when the panel 110 is removed, there are four signs 750 that each can be lifted from the inactive to the active position thereby providing an upstanding sign 750 at each of the four corners of the resulting space in the raised floor.

Figure 26:
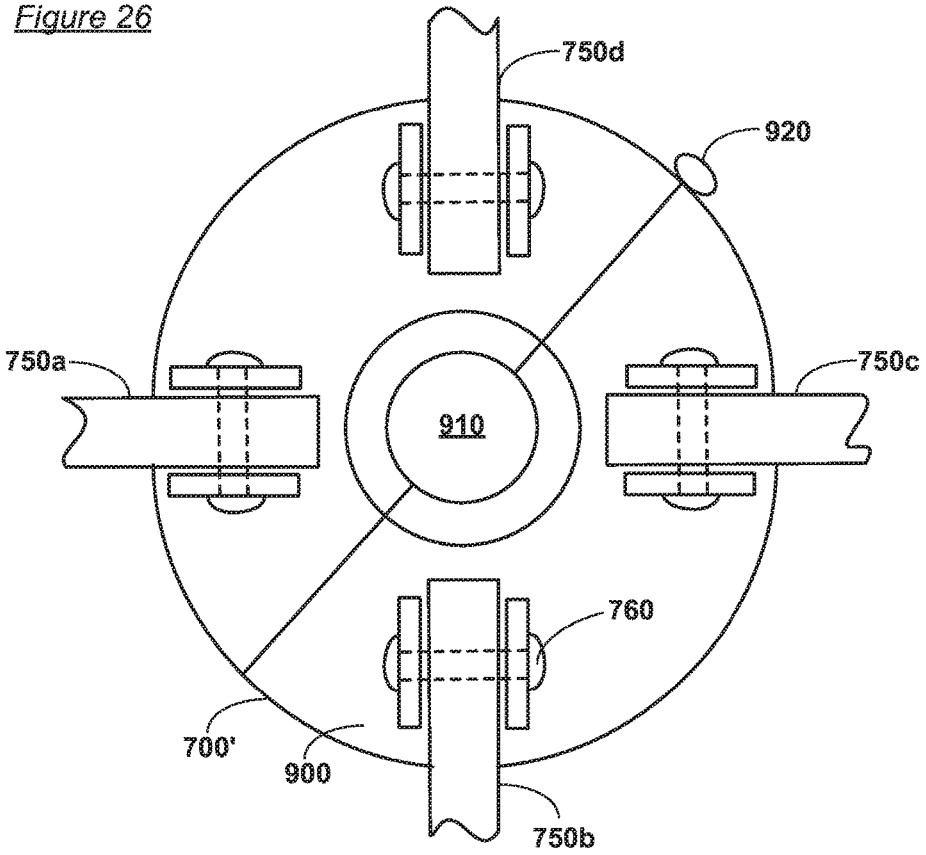
FIG. 26 is a plan view of the insert shown in FIG. 25.

Referring to FIG. 26, which shows the embodiment hereinbefore described with reference to FIG. 25 in plan view, the insert 700' may be provided in two halves hinged together via a hinge 920, with different pairs of the four signs 750*a* and 750*d* and 750*b* and 750*c* provided on each half. In operation the insert 700' is hinged open for attaching to the pedestal and then hinged closed around the pedestal 120 for securing thereto. One of the halves may contain a threaded bore for receiving a bolt via a smooth bore in the other half for tensioning the insert 700' onto the pedestal 120. It will be appreciated that the flanged portion 900 may be continuous or interrupted into four equidistantly spaced tabs each carrying a different one of the signs 750*a*-750*d*.

Figure 27:
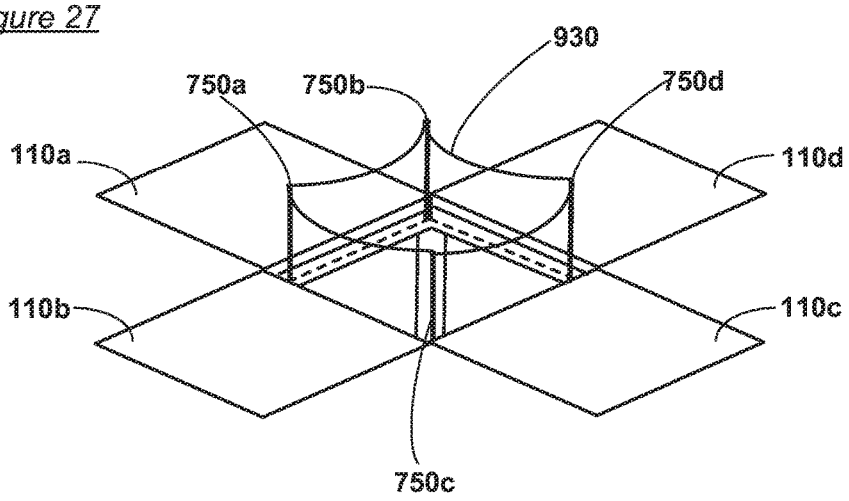
FIG. 27 is an isometric view of a raised floor system embodying the present invention with active signs.

With reference to FIG. 27, in embodiments in which there are four signs 750*a*-750*d* each pointing towards the centre of an overlying panel 110 when in the inactive position, a flexible elastic web 930 may interconnect the free ends of the signs 750*a*-750*d* such that, when the signs 750*a*-750*d* are deployed into the active position the web is stretched into a barrier surrounding the space in the floor left by the removed tile.

Figure 28:
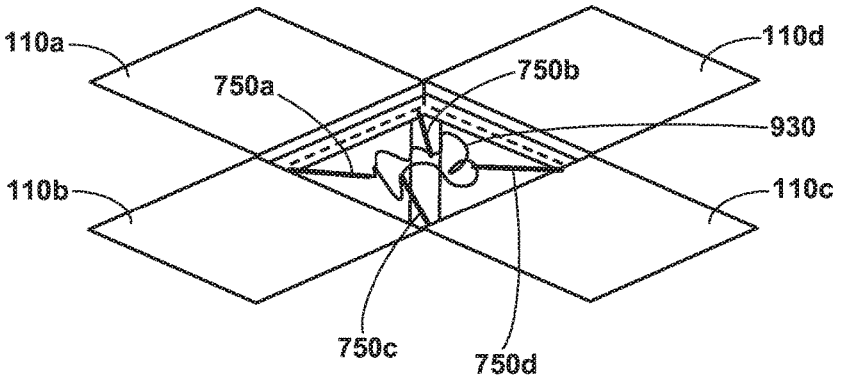
FIG. 28 is an isometric view of the flooring system shown in FIG. 27 with inactive signs.

Referring to FIG. 28, when signs 750*a*-750*d* are in the inactive position, the web 930 returns to a relaxed state for storage. It will be appreciated that, in other embodiments, the web 930 may be inelastic. In some embodiments, web 930 may retract into one or more reels attached to the signs 750*a*-750*d* when not in use.

It will be appreciated that inserts 700 and 700' may be formed from metal such as aluminium or steel or suitably durable plastics material.

In other embodiments, some only of flooring elements comprise such moveable elements. It will be understood by a person skilled in the art that other embodiments and variations of the described embodiments may be envisaged without departing from the scope of the present invention.

The invention claimed is:

1. A flooring element for a raised floor comprising removable flooring panels and a supporting structure and having a load bearing surface, the flooring element comprising:

a warning element associated with a flooring panel of said raised floor, said warning element operable for moving between an inactive position in which the warning element is substantially concealed by the surface and an active position in which the warning element projects beyond a surface of said flooring panel to form a visual hazard warning indicator responsive to the removal of an adjacent flooring panel.

2. The flooring element of claim 1, wherein the flooring element comprises one of: a flooring panel; a stringer; a pedestal; an insert for a pedestal; and an insert for inserting between sub-floor void and a flooring panel.

3. The flooring element of claim 1, wherein the warning element is substantially perpendicular to the surface when in the active position.

4. The flooring element of claim 1, wherein the warning element is substantially perpendicular to the surface when in the inactive position.

5. The flooring element of claim 1, wherein the warning element is substantially parallel to the surface when in the inactive position.

6. The flooring element of claim 1, wherein the warning element is attached to the flooring element by a pivot, the pivot being adjacent a corner of the flooring panel when in use in a floor, the warning element describing an arc of movement about the pivot in moving between the inactive position and the active position.

7. The flooring element of claim 1, wherein the warning element comprises a telescopic structure extendible from a retracted state in the inactive position to an extended state in the active position.

8. The flooring element of claim 1, further comprising a resilient bias for moving the warning element from the inactive position to the active position.

9. The flooring element of claim 1, wherein the warning element is lockable in the active position.

10. The flooring element of claim 1, wherein the warning element comprises one or more of: a plate; a perforated plate; a mesh; an elongate member; and a plurality of elongate members.

11. The flooring element of claim 1, wherein the warning element comprises one or more flexible elements operable for moving from the inactive position to the active position upon removal of the adjacent floor panel in response to a resulting flow of air through a flooring gap resulting from removal of the adjacent floor panel.

12. The flooring element of claim 11, wherein the flexible element comprises one or more of a streamer and a tube.

13. The flooring element of claim 1, wherein the warning element comprises a plurality of warning elements.

14. The flooring element of claim 13, wherein the plurality of warning elements are linked by a flexible web.

15. A flooring system comprising a flooring element of claim 1.

16. A flooring panel for a raised floor comprising a load bearing surface, the flooring panel comprising:

a warning element associated with the flooring panel operable for moving between an inactive position in which the warning element is substantially concealed by the surface and an active position in which the warning element projects beyond a surface of said flooring panel to form a visual hazard warning indicator responsive to the removal of an adjacent flooring panel.

* * * * *